US007913427B2

(12) United States Patent
Edwards et al.

(10) Patent No.: US 7,913,427 B2
(45) Date of Patent: Mar. 29, 2011

(54) ARTICLE OF FOOTWEAR FOR RIDING

(75) Inventors: D'Wayne Edwards, Beaverton, OR (US); Sean M. McDowell, Portland, OR (US); Julia Roether, Portland, OR (US)

(73) Assignee: Nike, Inc., Beaverton, OR (US)

( * ) Notice: Subject to any disclaimer, the term of this patent is extended or adjusted under 35 U.S.C. 154(b) by 761 days.

(21) Appl. No.: 11/862,853

(22) Filed: Sep. 27, 2007

(65) Prior Publication Data

US 2009/0083997 A1 Apr. 2, 2009

(51) Int. Cl.
*A43B 5/00* (2006.01)
*A43B 7/20* (2006.01)

(52) U.S. Cl. ..... 36/131; 36/69; 36/114; 36/74; D30/157; 54/83.1; 54/83.2

(58) Field of Classification Search ..... 36/313, 36/138, 132, 136, 114, 115, 84, 45, 113, 36/89; D30/157; 54/83.1, 83.2
See application file for complete search history.

(56) References Cited

U.S. PATENT DOCUMENTS

| | | | | |
|---|---|---|---|---|
| 82,921 | A | 10/1868 | Cooper | |
| 225,955 | A | 3/1880 | Tytler | |
| 256,606 | A * | 4/1882 | Thomson | 54/83.1 |
| 701,854 | A | 6/1902 | Davison | |
| 1,006,501 | A | 10/1911 | Ptaschinski | |
| 2,068,811 | A * | 1/1937 | McCrory | 36/45 |
| 2,132,066 | A * | 10/1938 | Alesci | 36/45 |
| 2,772,489 | A * | 12/1956 | Porter | 36/72 R |
| 4,642,910 | A | 2/1987 | Carter, Jr. et al. | |
| 6,536,196 | B2 * | 3/2003 | Harrison et al. | 54/83.1 |
| 6,665,954 | B2 * | 12/2003 | Chen | 36/3 R |
| 7,454,887 | B2 * | 11/2008 | Harrison et al. | 54/83.1 |
| 2003/0226287 | A1 * | 12/2003 | Borne | 36/131 |

FOREIGN PATENT DOCUMENTS

| | | |
|---|---|---|
| FR | 2681222 | 3/1993 |

* cited by examiner

*Primary Examiner* — Jila M Mohandesi
(74) *Attorney, Agent, or Firm* — Plumsea Law Group, LLC

(57) ABSTRACT

An article of footwear for riding is disclosed. The article includes a second portion of an upper having a second coefficient of friction that is greater than a first coefficient of friction associated with a first portion of an upper. The article further includes a detachable spur member configured to attach to a heel counter of the article.

20 Claims, 8 Drawing Sheets

ARTICLE OF FOOTWEAR FOR RIDING

BACKGROUND OF THE INVENTION

1. Field of the Invention

The present invention relates generally to footwear and in particular an article of footwear configured to be worn during horseback riding.

2. Description of Related Art

Articles of footwear configured for riding generally include features for facilitating control of a horse. Typically, these articles of footwear are manufactured as boots, since a large area of the foot and calf may be exposed to the sides of a horse during riding. Additionally, an article of footwear for riding may include spurs or other features for facilitating control of a horse or for aesthetic purposes.

Articles of footwear for riding may include spurs that may be used to 'prod' a horse during riding. Articles of footwear with spurs often include u-shaped collars that project outwardly from the rear of the heel. These u-shaped collars, however, can be bulky and often must be stored separately from the article of footwear. Alternative designs for removable spurs have been previously proposed.

Borne (U.S. patent number 2003/0226287) teaches a boot including a heel with a rear side having a two-component coupling member. The two-component member includes a male component that is associated with a spur and a female component that is associated with a heel. Borne teaches the use of both quick connectors and screw type couplings for the two-component member. For example, when a screw type coupling is used, the spur can be manually attached to the heel by screwing the male component into the female component.

Harrison (U.S. Pat. No. 6,536,196) also teaches the use of a strapless spur with a boot or other type of footwear. Harrison teaches a base that is threaded and built into the boot as well as a threaded spur including a knuckled annular base that facilitates screwing of the spur into the threaded base. Harrison also teaches the use of a telescoping spur that may be extended during use.

The related art lacks methods for attaching spurs at other parts of an article of footwear besides the heel. The related art devices may also lack durability and strength of the spur mounting system. There is a need in the art for a design that solves these problems.

SUMMARY OF THE INVENTION

An article of footwear configured for riding is disclosed. In one aspect, the invention provides an article of footwear configured for riding, comprising: a heel counter that is disposed away from a heel of the footwear; a connector associated with the heel counter, the connector including a thread receiving portion; a detachable spur member including a body portion and a threaded portion; and where the threaded portion is configured to engage the thread receiving portion and thereby connect the spur member to the heel counter.

In another aspect, the heel counter is associated with a first connector and a second connector, the second connector being disposed below the first connector.

In another aspect, the spur member is attached to the first connector.

In another aspect, the spur member is attached to the second connector.

In another aspect, the heel counter includes an interior cavity.

In another aspect, the interior cavity is configured to reduce the weight of the heel.

In another aspect, the first connector and the second connector are low profile threaded connectors.

In another aspect, the upper includes a first portion having a first coefficient of friction and a second portion having a second coefficient of friction.

In another aspect, the second coefficient of friction is greater than the first coefficient of friction.

In another aspect, the second portion is disposed on a medial portion of the upper.

In another aspect, the invention provides an article of footwear configured for riding, comprising: an upper including a first portion and a second portion; the first portion having a first coefficient of friction and the second portion having a second coefficient of friction that is greater than the first coefficient of friction; and where the second portion is disposed above an ankle region on a medial portion of the upper.

In another aspect, the upper includes an ankle pad associated with the ankle region.

In another aspect, the article of footwear includes a heel counter.

In another aspect, the heel counter is disposed away from a heel.

In another aspect, the heel counter includes a first connector and a second connector.

In another aspect, the first connector and the second connector are low profile threaded connectors.

In another aspect, the article of footwear is associated with a spur member having a body portion and a threaded portion.

In another aspect, the first connector has a first thread receiving portion and the second connector has a second thread receiving portion.

In another aspect, the threaded portion of the spur member is configured to engage the first connector at the first thread receiving portion.

In another aspect, the threaded portion of the spur member is configured to engage the second connector at the second thread receiving portion.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
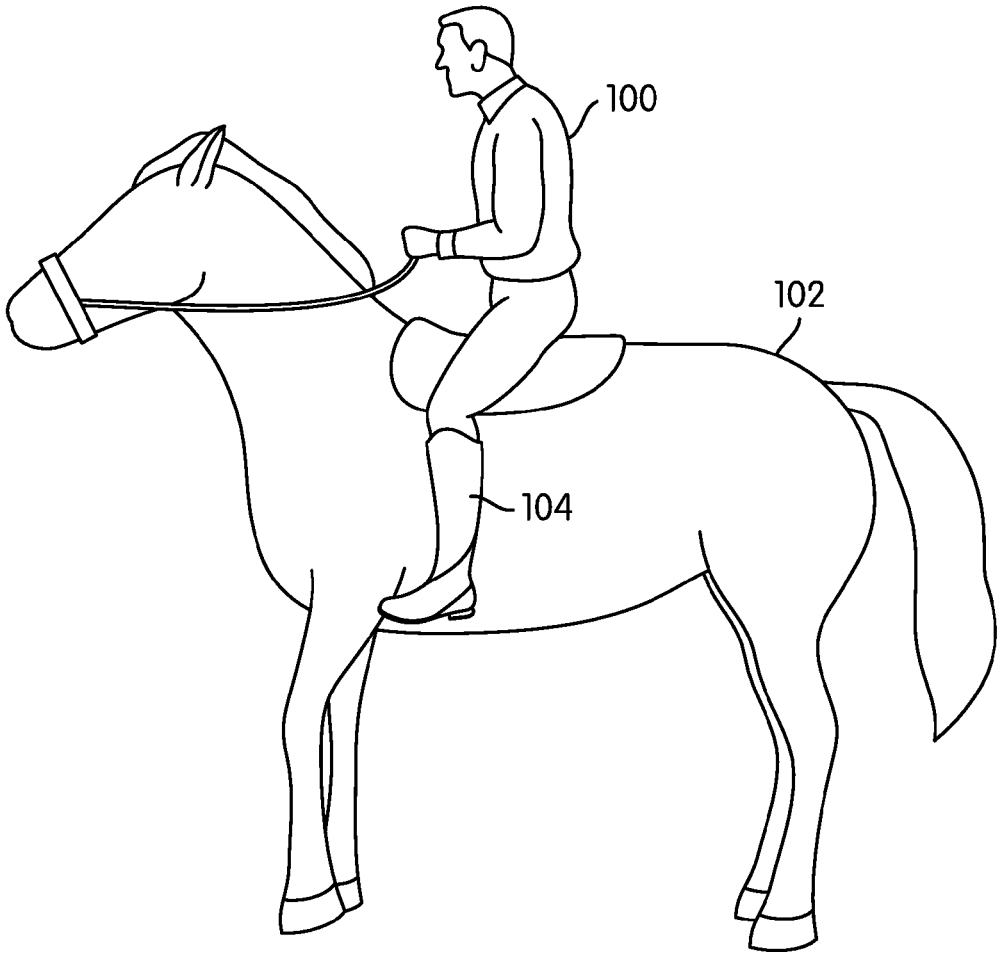
FIG. 1 is a preferred embodiment of a rider mounted on a horse.

FIG. 1 is a preferred embodiment of rider 100 mounted on horse 102. Rider 100 could be anyone trained to ride a horse. In some cases, rider 100 may be an athlete of some kind, such as a jockey or a competitor in equestrian events. In other embodiments, rider 100 could be a leisure rider or a beginning rider.

In a preferred embodiment, rider 100 may be wearing article of footwear 104. Preferably, article of footwear 104 may be a boot of some kind. In the current embodiment, article of footwear 104 is preferably configured to be worn in various types of equestrian events. Examples of equestrian events include: dressage, show jumping, eventing, equestrian vaulting, and endurance riding.

Figure 2:
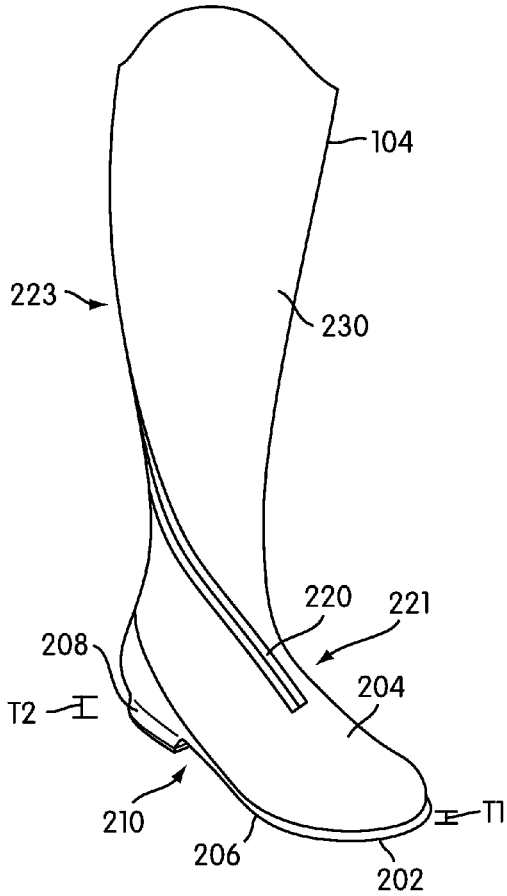
FIG. 2 is an isometric view of a preferred embodiment of an article of footwear.
Figure 3:
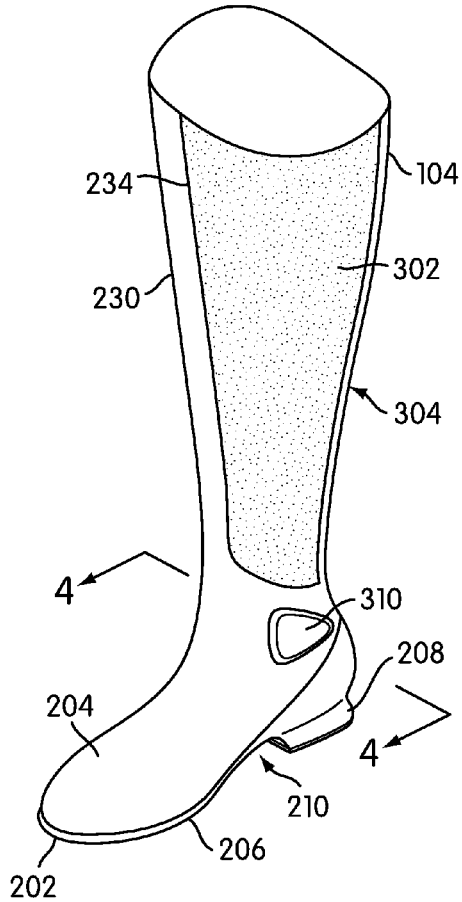
FIG. 3 is an isometric view of a preferred embodiment of an article of footwear.

FIGS. 2 and 3 are isometric views of a preferred embodiment of article of footwear 104. In a preferred embodiment, article of footwear 104 may be a riding boot. For clarity, the following detailed description discusses a preferred embodiment; however, it should be kept in mind that the present invention could also take the form of any other kind of footwear that may be used for riding. Additionally, in some cases, the principles taught here may be applied to other types of footwear, including, for example, basketball shoes, running shoes, football cleats, boots, as well as other kinds of footwear. As shown throughout the figures, article of footwear 104 is intended to be used with a right foot, however it should be understood that the following discussion may equally apply to a mirror image of article of footwear 104 that is intended for use with a left foot.

Article of footwear 104 may include outer member 202. Generally, outer member 202 may comprise an insole, a midsole and an outsole. In some embodiments, outer member 202 may comprise only an insole. In other embodiments, outer member 202 may comprise only a midsole. In some embodiments, outer member 202 may comprise only an outsole. Also, it should be understood that other embodiments may include any combination of an insole, a midsole and an outsole.

Outer member 202 preferably includes front sole 206 and heel 208. Front sole 206 is preferably configured to provide support to a forefoot of rider 100. Front sole 206 may have a first thickness T1. Generally, the value of thickness T1 may vary between half a centimeter and several centimeters. Likewise, heel 208 may be configured to provide support to a heel of rider 100. Preferably, heel 208 has a second thickness T2 that is greater than first thickness T1. The value of thickness T2 may vary between one centimeter and ten centimeters. In a preferred embodiment, the value of thickness T2 is approximately five centimeters.

Preferably, outer member 202 is raised at arch region 210 of article of footwear 104. This arrangement may facilitate foot support by conforming to the natural arch associated with the foot of rider 100. By varying the thicknesses of front sole 206 and heel 208, the height and shape of arch region 210 may be modified.

Front sole 206 and heel 208 may be made from a substantially rigid material. In some embodiments, front sole 206 and heel 208 may be made of a dense rubber, plastic, coated wood or any other stiff material. Examples of other suitable materials include, but are not limited to, elastomers, siloxanes, aluminum, steel, natural leather, synthetic leather, or plastics. In the current embodiment, front sole 206 and heel 208 are made of a similar material, however, in some embodiments, front sole 206 and heel 208 may be made of different materials. For example, in some embodiments, front sole 206 could be made of a rubber configured to provide traction, while heel 208 may be made of a substantially rigid material configured to provide stability for article of footwear 104.

Outer member 202 may be associated with upper 204. Preferably, upper 204 is configured to receive a foot of rider 100. Additionally, in some embodiments, upper 204 may be configured to receive the lower leg of rider 100. In this preferred embodiment, upper 204 is configured to cover the calf of rider 100. Using this preferred arrangement, upper 204 provides protection to the leg and calf of rider 100 during riding, which are generally exposed to sides 108 of horse 102 during riding (see FIG. 1).

Article of footwear 104 may include a fastening system of some kind configured to adjustably tighten upper 204 to the foot of rider 100. In some embodiments, upper 204 may include fastening member 220. Generally, fastening member 220 could be any type of fastening system known in the art for fastening boots or similar types of footwear. Examples of fastening systems include straps, laces, buttons and snaps. In this preferred embodiment, fastening member 220 is a zipper.

In some embodiments, fastening member 220 may be configured to wrap around upper 204. In some cases, fastening member 220 is configured to extend down lateral side portion 223 of upper 204. In other cases, fastening member 220 may extend across instep portion 221 of upper 204. In a preferred embodiment, fastening member 220 may extend from lateral side portion 223 to instep portion 221 in order to help tighten upper 204 at instep portion 221 and lateral side portion 223, simultaneously.

Preferably, article of footwear 104 includes provisions that facilitate riding. In some embodiments, article of footwear 104 may include provisions that help rider 100 grip sides 108 of horse 102 (see FIG. 1). In some embodiments, upper 204 may include provisions that increase friction between horse 102 and upper 204. In a preferred embodiment, upper 204 may include provisions for increasing friction on an inner or medial side of upper 204 that is most often in contact with horse 102.

In this embodiment, upper 204 preferably comprises two distinct portions, including first portion 230 and second portion 302. First portion 230 and second portion 302 are divided by first periphery 234 in this embodiment. In this embodiment, first portion 230 comprises a majority of upper 204. Second portion 302, on the other hand, extends over medial calf region 304 of upper 204.

Preferably, first portion 230 is associated with a first coefficient of friction. Likewise, second portion 302 is associated with a second coefficient of friction. In this preferred embodiment, the second coefficient of friction is greater than the first coefficient of friction. In other words, second portion 302 is configured to more readily grip sides 108 of horse 102 that first portion 230.

Generally, first portion 230 and second portion 302 may be made of any materials with differing coefficients of friction. Preferably, first portion 230 may be made from any material that is suitable for use as an upper. Preferably, first portion 230 may be made of a material that is commonly used in riding shoes, including characteristics such as durability and aesthetic appeal. Examples of suitable materials include, but are not limited to, nylon, natural leather, synthetic leather, as well as other materials. In a preferred embodiment, first portion 230 is made of natural leather.

Preferably, second portion 302 is made of a material with a higher coefficient of friction than the materials discussed with respect to first portion 230. Examples of materials that could be used for second portion 302 include, but are not limited to, natural or synthetic rubbers, elastomers, rough fabrics, as well as other suitable materials. In a preferred embodiment, second portion 302 is made of a rubber material.

Additionally, in some embodiments, upper 204 may include provisions for protecting one or more regions of the foot of rider 100. In some embodiments, upper 204 may include padding configured to absorb shocks. In a preferred embodiment, upper 204 may include padding configured to protect the ankle of rider 100.

In some embodiments, upper 204 may include ankle pad 310. Generally, ankle pad 310 may have any shape. In this embodiment, ankle pad 310 is triangular. In other embodiments, however, ankle pad 310 could be round, rectangular, or have any other kind of shape.

Figure 4:
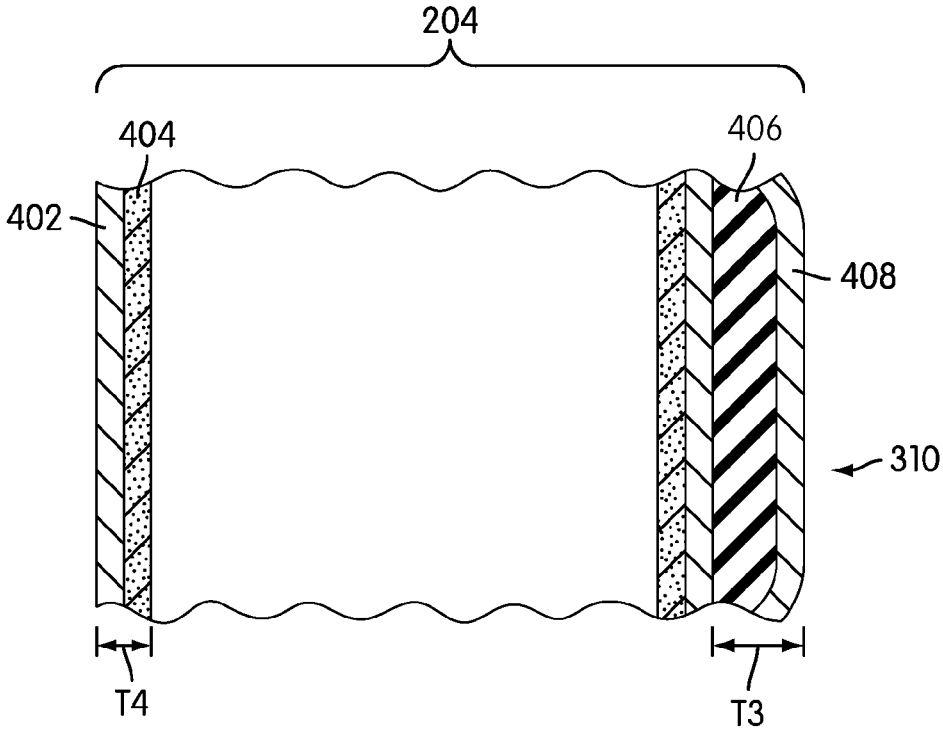
FIG. 4 is a cross sectional view of a preferred embodiment of an upper of an article of footwear.

FIG. 4 is a cross section of upper 204 intended to illustrate a preferred layering for upper 204, including ankle pad 310. Preferably, upper 204 includes two layers. In some embodiments, upper 204 includes outer layer 402. Outer layer 402 is preferably made of one of the materials previously discussed for first portion 230 of upper 204. In a preferred embodiment, outer layer 402 may be made of leather.

Upper 204 preferably includes inner layer 404. In some embodiments, inner layer 404 may be a breathable layer configured for ventilation of a foot. In some embodiments, inner layer 404 could be a breathable fabric layer. In other embodiments, inner layer 404 could be a layer of thin padding, such as thin foam.

Generally, ankle pad 310 may comprise multiple layers as well. In some embodiments, ankle pad 310 may comprise padding layer 406 and outer cover 408. Padding layer 406 may be a foam layer or another material configured for shock absorption. In some embodiments, outer cover 408 comprises a substantially similar material to outer layer 402. In a preferred embodiment, outer cover 408 may comprise a leather material. Using this configuration, outer cover 408 may help to protect padding layer 406 of ankle pad 310. This arrangement may increase the lifetime and durability of padding layer 406, as well as increase the aesthetics of ankle pad 310.

Layers 402, 404 and 406 may be combined using any methods known in the art. In some cases, layers 402 and 404 may be sewn or stitched together. In other embodiments, layers 402 and 404 may be attached using an adhesive of some kind. Likewise, padding layer 406 could be sewn, stitched or glued to outer layer 402 and/or outer cover 408.

In a preferred embodiment, ankle pad 310 may be thicker than upper 204. In this embodiment, ankle pad 310, comprising padding layer 406 and outer cover 408, has a thickness T3. Upper 204, comprising outer layer 402 and inner layer 404, has a thickness T4. Preferably, thickness T3 is substantially larger than thickness T4. For example, in some embodiments, thickness T3 could be at least twice as large as thickness T4. Using this configuration may generally increase the effectiveness of ankle pad 310 for absorbing contact and decreasing the tendency of bruising to the ankle of rider 100.

Figure 5:
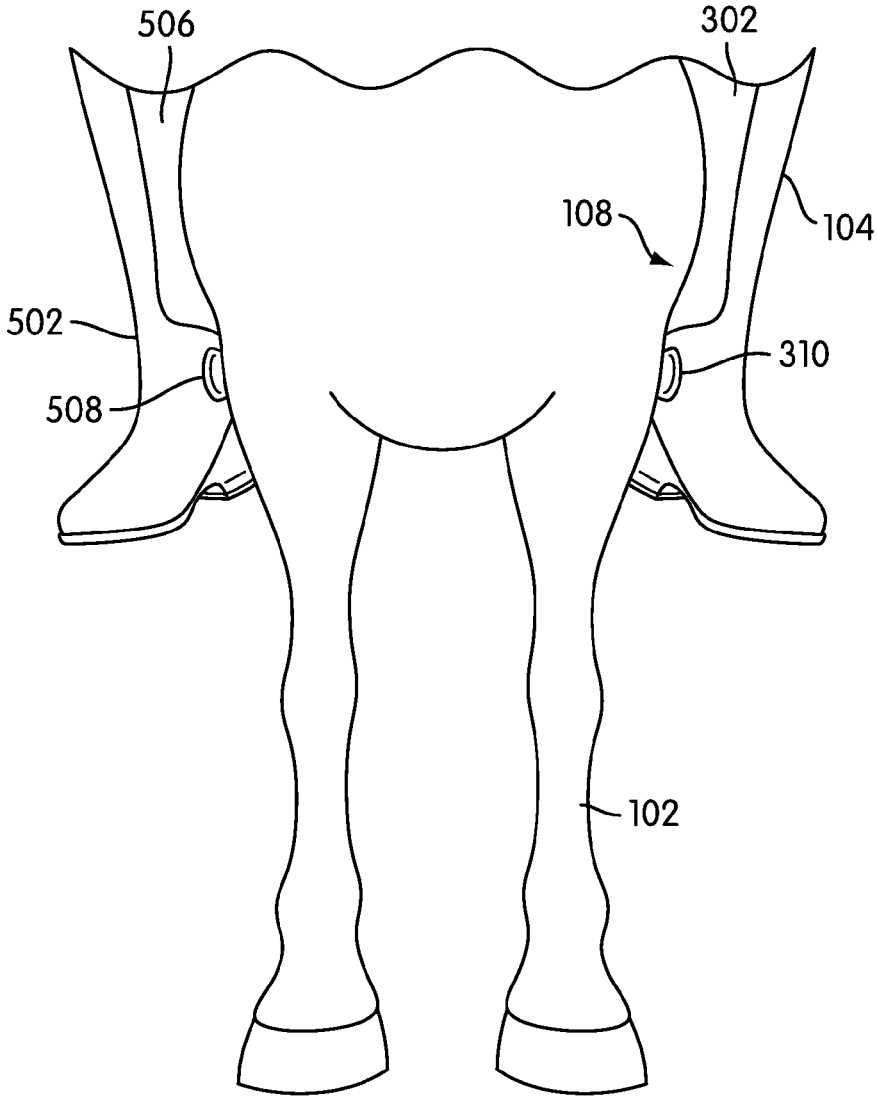
FIG. 5 is a preferred embodiment of a rider mounted on a horse.

FIG. 5 is intended to illustrate the utility of second portion 302 and ankle pad 310 during riding. In the current embodiment, article of footwear 104 is also associated with complementary article of footwear 502. In this embodiment, complementary article of footwear 502 includes third portion 506 and second ankle pad 508.

In this embodiment, articles 104 and 502 are generally disposed against sides 108 of horse 102. During a gallop or similar motions of horse 102, it may be necessary for rider 100 to grip sides 108 tightly with articles 104 and 502 in order to maintain proper balance. In this case, portions 302 and 506 are configured to grip sides 108. In particular, because portions 302 and 506 have high coefficients of friction, portions 302 and 506 may act to hold articles 104 and 502 in place against sides 108 of horse 102.

In addition, ankle pads 310 and 508 preferably facilitate protection for the ankles of rider 100 during a gallop or other motions of horse 102. In prior designs, as a rider squeezes their boots against the sides of a horse, there may be a tendency to bruise their ankles. Using this preferred configuration, however, ankle pads 310 and 508 may prevent bruising and this may help rider 100 maintain proper balance or position for extended periods of time.

Often, non-deforming materials are considerably heavier than deformable materials. Article of footwear 104 includes heel 208 that is preferably constructed of a non-deforming material, such as hard plastic, which may tend to weigh significantly more than heels made of rubber or lightweight plastics. Preferably, heel 208 includes provisions for reducing the weight of heel 208. With this configuration, the overall weight of article of footwear 104 may be reduced without compromising the structural integrity of article of footwear 104.

Figure 6:
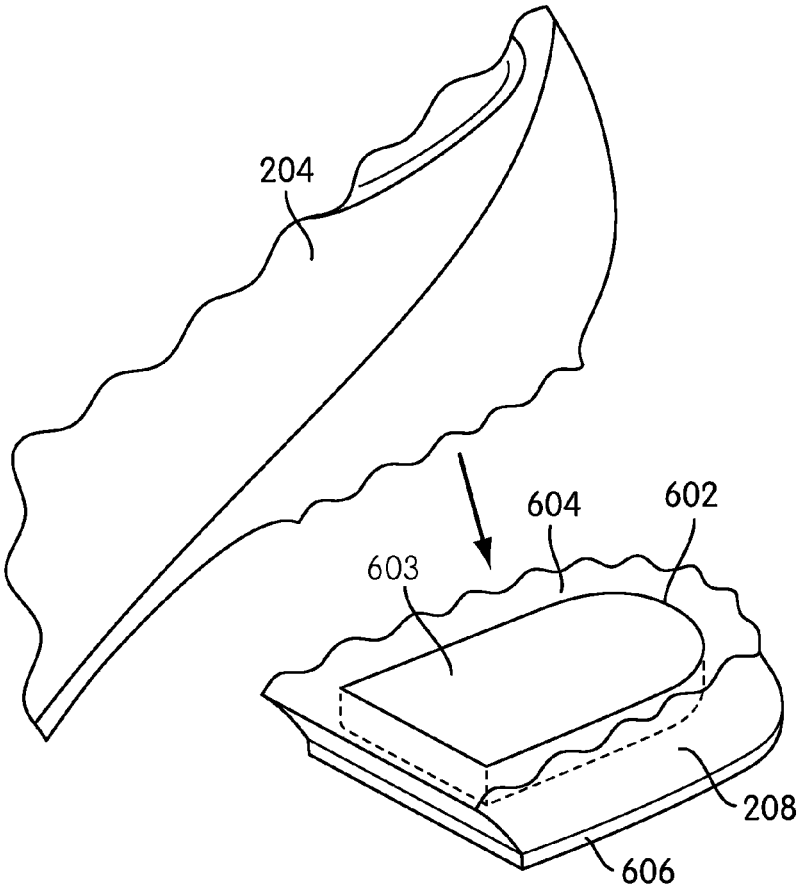
FIG. 6 is a cutaway view of a preferred embodiment of a heel of an article of footwear.

FIG. 6 is a cutaway view of a preferred embodiment of heel 208. In this embodiment, heel 208 has been pulled or cut away from upper 204. Preferably, heel 208 is constructed in a manner that includes one or more cavities. In this embodiment, heel 208 includes interior cavity 602. Generally, interior cavity 602 is a hollowed out portion of heel 208. In some embodiments, interior cavity 602 may be open at upper surface 604 of heel 208. In a preferred embodiment, interior cavity 602 does not extend to lower surface 606 of heel 208. This sealed arrangement prevents debris from entering and clogging interior cavity 602. Preferably, interior cavity 602 is also sealed off by upper 204 at upper surface 604.

Interior cavity 602 may be any size or shape as long as the structural integrity of heel 208 is not compromised. In the current embodiment, interior cavity 602 has a generally rectangular cross section with a single rounded side. In other embodiments, interior cavity 602 could have a circular or an irregular cross section. Additionally, the length, width and depth of interior cavity 602 may vary. Preferably, interior cavity 602 is large enough to substantially reduce the weight of heel 208.

Interior cavity 602 may be formed by a variety of processes. In some embodiments, interior cavity 602 may be formed by drilling. In other embodiments, interior cavity 602 may be removed from heel 208 using a method other than drilling. In still other embodiments, interior cavity 602 may be created during the original molding of heel 208.

In some cases, interior cavity 602 may be filled with one or more lightweight materials. In this preferred embodiment, interior cavity 602 may include foam block 603. Preferably, foam block 603 is molded to fill the entirety of interior cavity 602.

This embodiment is only meant to illustrate one configuration for interior cavity 602. In other embodiments, the number of cavities, as well as their general configuration within heel 208, may vary. Some embodiments may include multiple cavities of various sizes and depths. Still other embodiments may include cavities that are oriented in specific patterns, including ring-like patterns, grid-like patterns, as well as other kinds of patterns.

Typically, articles of footwear configured for riding include spurs. In some cases, spurs may be decorative. In other situations, spurs could be used for controlling a horse. In some cases, spurs are configured to be removable to reduce the bulkiness of articles of footwear configured for riding. Generally, spurs are attached to an article of footwear using a yolk-like arrangement in which the spurs are fastened around the heel of the boot.

Preferably, article of footwear 104 includes provisions for easily attaching and detaching spurs. In some embodiments, article of footwear 104 may include a fastening system for a spur that may be provide for quick attachment and release of the spur. These provisions may allow for article of footwear 104 to be more easily carried when article 104 is not being worn, since footwear with attached spurs can be bulky and awkward.

Additionally, article of footwear 104 may include provisions for raising the height of a spur along a rider's foot or leg. In some embodiments, a spur may be associated with a heel counter rather than a heel of an article of footwear. This arrangement may provide a higher pivoting point for the spur.

Figure 7:
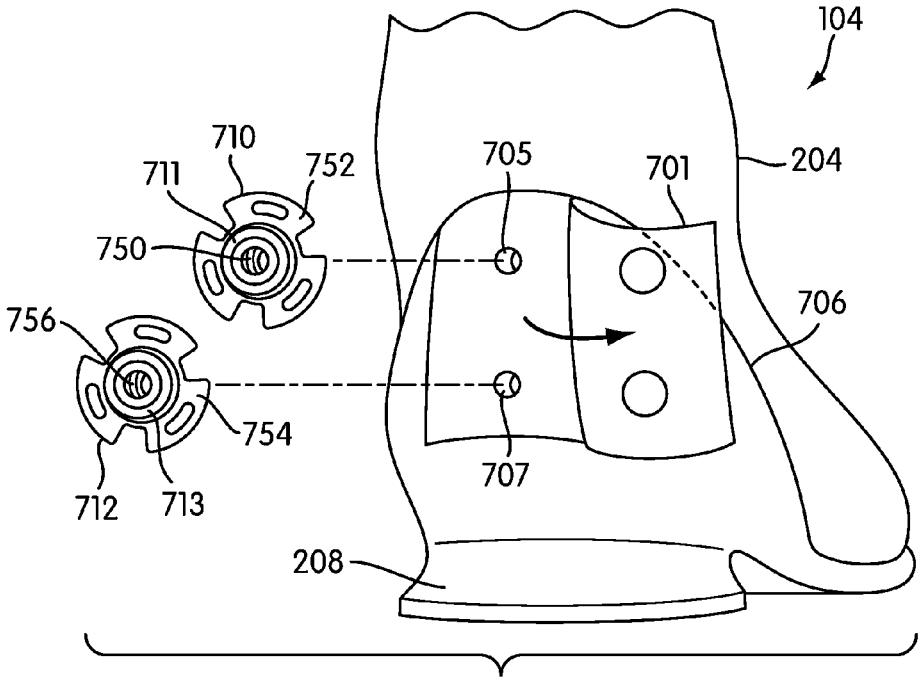
FIG. 7 is an exploded isometric view of a preferred embodiment of an article of footwear configured to receive a detachable spur at a heel counter.

FIG. 7 is an exploded isometric view of a preferred embodiment of article of footwear 104 including provisions for receiving a detachable spur. As previously discussed, article of footwear 104 may include heel 208. In a preferred embodiment, article of footwear 104 may also include heel counter 706. In some cases, heel counter 706 may be disposed above heel 208. In this embodiment, outer layer 701 of article of footwear 104 has been peeled back so that heel counter 706 may be clearly seen.

In some embodiments, heel counter 706 is disposed outward of upper 204. In some embodiments, heel counter 706 may enclose a rear portion of upper 204. In other embodiments, heel counter 706 may be continuously connected with upper 204. Preferably, heel counter 706 may function to provide support and protection to a heel.

Heel counter 706 may be made of a rigid material configured to provide additional support to the heel of a rider. In some embodiments, heel counter 706 may be made of a durable rubber. In other embodiments, heel counter 706 may be made of substantially the same material as upper 204. In a preferred embodiment, heel counter 706 may be made of a durable plastic.

In some embodiments, heel counter 706 may include one or more holes. In this case, heel counter 706 includes first hole 705 and second hole 707. Preferably, first hole 705 is disposed above second hole 707. In other embodiments, the relative position of holes 705 and 707 can be varied.

Article of footwear 104 preferably includes one or more connectors that are configured to receive a spur member. In this embodiment, article of footwear 104 may include first connector 710 and second connector 712. Preferably, first connector 710 is configured to associate with first hole 705. Likewise, second connector 712 is configured to associate with second hole 707.

Generally, connectors 710 and 712 may be any kind of connectors. Examples of various kinds of connectors include, but are not limited to, snap connectors, threaded connectors, buckle connectors as well as other types of connectors. In a preferred embodiment, connectors 710 and 712 are low profile threaded connectors.

Generally, connectors 710 and 712 may be made of any durable material. In some cases, connectors 710 and 712 may be made of a plastic material, including clear plastics. In other cases, connectors 710 and 712 may be made of a metal of some kind.

In this embodiment, first connector 710 includes first barreled portion 711. Generally, first barreled portion 711 may be inserted into first hole 705. Additionally, first barreled portion 711 may include first thread receiving portion 750. In some embodiments, first connector 710 may also include first flange portions 752 that are configured to fix first connector 710 in place between heel counter 706 and outer layer 701. In other words, first flange portions 752 may be useful in anchoring first connector 710 in place. In a preferred embodiment, first flange portions 752 may bisect first barrel portion 711.

Preferably second connector 712 includes similar provisions to first connector 710. For example, second connector 712 may include second barreled portion 713. Additionally, second connector 712 may include second flange portions 754 for anchoring second connector 712 into place. In a preferred embodiment, second flange portions 754 may bisect second barrel portion 713. Finally, second connector 712 may also include second thread receiving portion 756.

Figure 8:
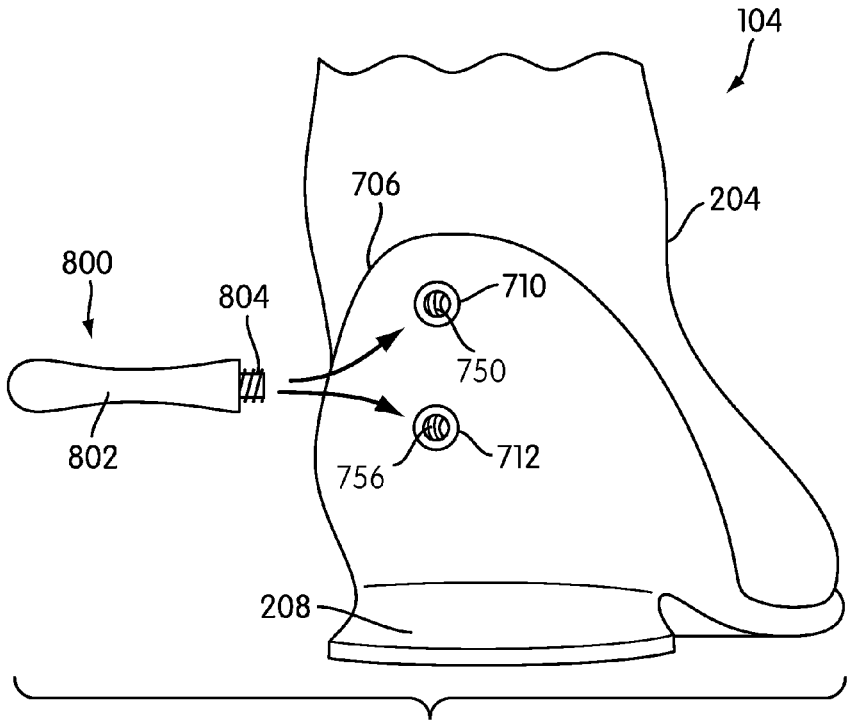
FIG. 8 is an isometric view of a preferred embodiment of an article of footwear configured to receive a detachable spur at a heel counter.
Figure 9:
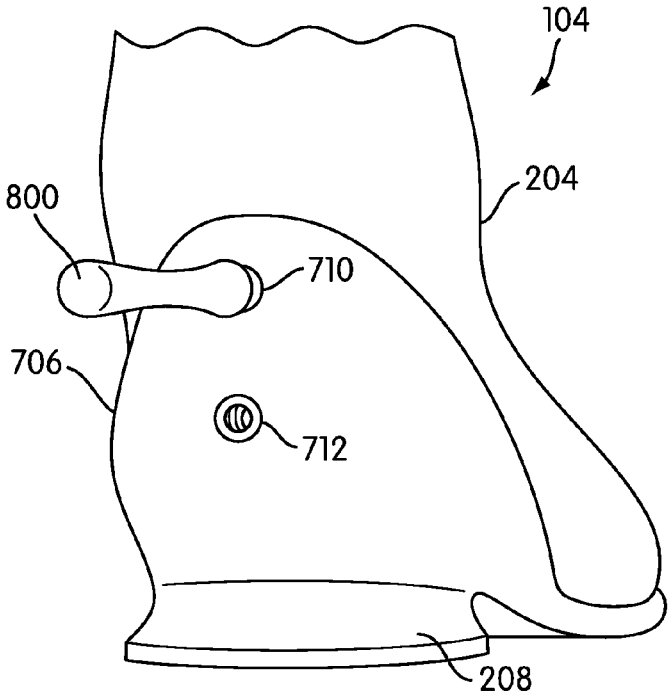
FIG. 9 is an isometric view of a preferred embodiment of an article of footwear configured to receive a detachable spur at a heel counter.
Figure 10:
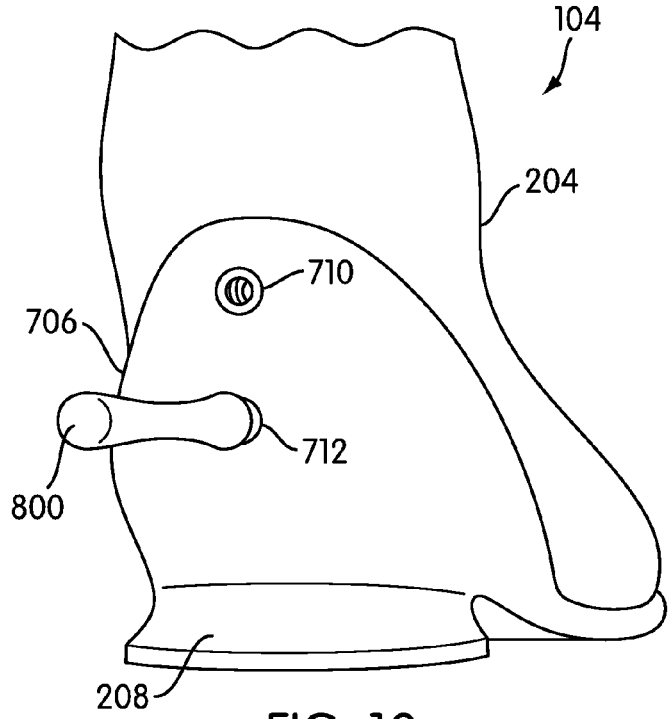
FIG. 10 is an isometric view of a preferred embodiment of an article of footwear configured to receive a detachable spur at a heel counter.

Referring to FIGS. 8-10, spur member 800 may be associated with article of footwear 104. Preferably, spur member 800 includes body portion 802. In some cases, body portion 802 may be generally cylindrical in shape with a rounded end for contacting the side of a horse. In particular, the end of body portion 802 may be blunted. Spur member 800 may also include threaded portion 804. In some cases, threaded portion 804 may be configured to insert into thread receiving portions of a connector. In particular, threaded portion 804 may engage first thread receiving portion 750. Likewise, threaded portion 804 may engage second thread receiving portion 756. The current embodiment is only intended to be exemplary, and it should be understood that in other embodiments, different types of spur members could be used, including spur members with pricks or rowels.

In this embodiment, spur member 800 may be attached to article of footwear 104 at first connector 710 or second connector 712. Referring to FIG. 9, spur member 800 may be attached at first connector 710. Likewise, referring to FIG. 10, spur member 800 may be attached at second connector 712. Although the preferred embodiment includes two attachment points, associated with first connector 710 and second connector 712, in other embodiments, additional attachment points associated with additional connectors could also be used. These additional connectors could be inserted at varying heights on the heel counter. This arrangement allows the user to select between different heights for the spur.

Figure 11:
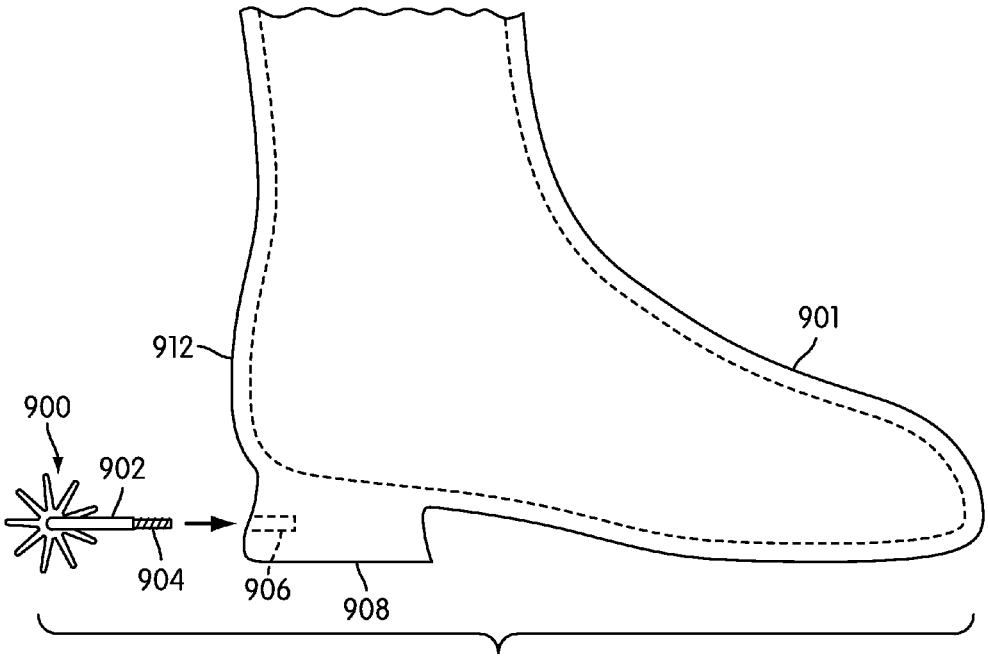
FIG. 11 is a side view of an exemplary embodiment of an article of footwear with a spur member.
Figure 12:
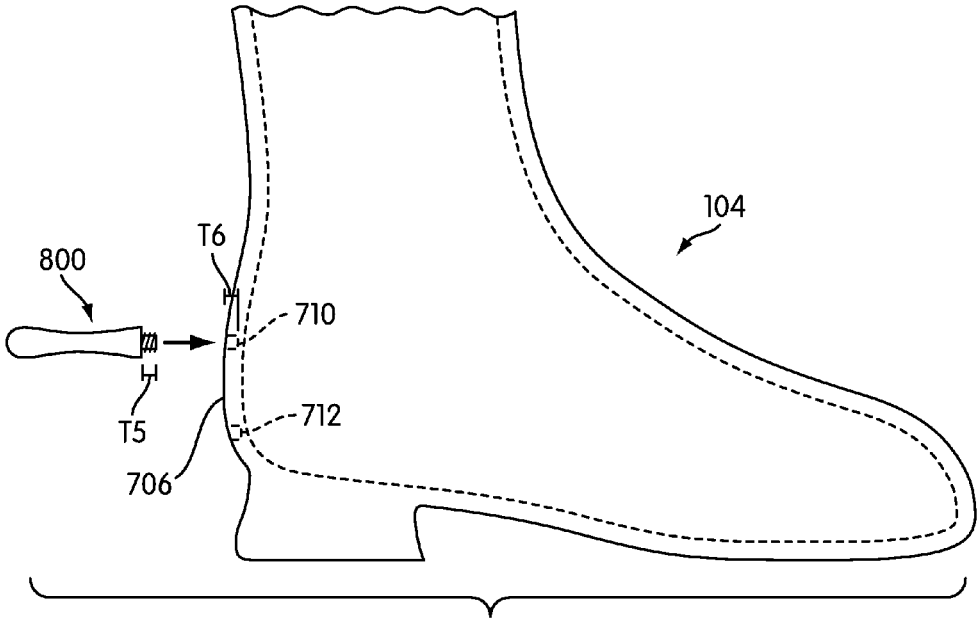
FIG. 12 is a side view of a preferred embodiment of an article of footwear with a spur member.

FIGS. 11 and 12 are intended to illustrate the utility of using low profile connectors to attach a spur member over prior designs. In prior designs, illustrated in FIG. 11, detachable spur member 900 comprises post 902 and threaded portion 904. In order to facilitate a strong connection, threaded portion 904 must be inserted into thread receiving portion 906 at heel 908.

In the current design, illustrated in FIG. 12, connectors 710 and 712 have a thickness T5 that is equal to or less than the thickness T6 of heel counter 706. Therefore, using this preferred arrangement, spur member 800 may be directly attached to heel counter 706 at first connector 710 or second connector 712. This arrangement allows spur member 800 to be disposed higher on article of footwear 104 than with previous designs. In some cases, this higher mounting position may decrease the tendency of spur member 800 to drag on the ground when a user is walking. Furthermore, since a heel counter is generally longer than a heel, the current design allows for an increased range of attachment points for spur member 800, allowing the rider the flexibility to choose to attach spur member 800 at multiple different heights on article of footwear 104.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. An article of footwear configured for riding, comprising:

an outer layer;

a heel counter that is disposed away from a heel of the footwear;

a first connector and a second connector associated with the heel counter, the first connector including a first thread receiving portion and the second connector including a second thread receiving portion;

the first connector and the second connector being disposed at different positions away from the heel, wherein the second connector is disposed further from the heel than the first connector;

a detachable spur member including a body portion and a threaded portion;

wherein the threaded portion is configured to separately engage the first thread receiving portion and the second thread receiving portion and thereby selectively connect the spur member to the heel counter at one of the first thread receiving portion and the second thread receiving portion; and wherein the first connector and the second connector are each disposed between the heel counter and the outer layer.

2. The article of footwear according to claim 1, wherein a thickness of the first connector is equal to or less than a thickness of the heel counter, and a thickness of the second connector is equal to or less than a thickness of the heel counter.

3. The article of footwear according to claim 1, wherein the spur member is attached to the first connector.

4. The article of footwear according to claim 1, wherein the spur member is attached to the second connector.

5. The article of footwear according to claim 1, wherein the heel counter includes an interior cavity.

6. The article of footwear according to claim 5, wherein the interior cavity is configured to reduce the weight of the heel.

7. The article of footwear according to claim 1, wherein the first connector and the second connector are low profile threaded connectors.

8. The article of footwear according to claim 7, wherein an upper includes a first portion having a first coefficient of friction and a second portion having a second coefficient of friction.

9. The article of footwear according to claim 8, wherein the second coefficient of friction is greater than the first coefficient of friction.

10. The article of footwear according to claim 9, wherein the second portion is disposed on a medial portion of the upper.

11. The article of footwear according to claim 9, wherein the second portion is disposed above an ankle region on a medial portion of the upper.

12. The article of footwear according to claim 11, wherein the upper includes an ankle pad associated with the ankle region.

13. The article of footwear according to claim 11, wherein the first connector and the second connector are low profile threaded connectors.

14. An article of footwear configured for riding, comprising:

an outer layer;

a heel counter that is disposed away from a heel of the footwear;

a connector associated with the heel counter, the connector including a barreled portion, the barreled portion including a thread receiving portion configured to connect a detachable spur member to the heel counter; and wherein the connector has a flange portion that extends radially outward from the barreled portion, and the flange portion is configured to fix the connector between the heel counter and the outer layer.

15. The article of footwear according to claim 14, wherein a thickness of the connector is equal to or less than a thickness of the heel counter.

16. The article of footwear according to claim 14, further comprising:

the spur member including a body portion and a threaded portion, wherein the threaded portion is configured to engage the thread receiving portion and thereby connect the spur member to the heel counter.

17. The article of footwear according to claim 14, wherein the heel counter is associated with a first connector and a second connector; and wherein the second connector is disposed below the first connector.

18. The article of footwear according to claim 16, wherein the spur member is attached to one of the first connector and second connector.

19. An article of footwear configured for riding, comprising:

a heel counter that is disposed away from a heel of the footwear;

a first connector and a second connector associated with the heel counter, the first connector including a first barreled portion having a first thread receiving portion and the second connector including a second barreled portion having a second thread receiving portion;

the first connector and the second connector being disposed at different positions away from the heel;

wherein the first thread receiving portion and the second thread receiving portion are each configured to individually connect a spur member to the heel counter at different positions;

wherein the first connector includes a first flange portion that extends radially outward from the first barreled portion and the second connector includes a second flange portion that extends radially outward from the second barreled portion; and wherein the first flange portion is configured to anchor the first connector on the heel counter and the second flange portion is configured to anchor the second connector on the heel counter.

20. The article of footwear according to claim 19, further comprising:

a detachable spur member including a body portion and a threaded portion, wherein the threaded portion is configured to separately engage the first thread receiving portion and the second thread receiving portion and thereby selectively connect the spur member to the heel counter at one of the first connector and the second connector.

* * * * *